US005971378A

United States Patent [19]

Sweeney

[11] Patent Number: 5,971,378

[45] Date of Patent: Oct. 26, 1999

[54] SOFT SQUEEZE CLAMP AND EXPANSION DEVICE

[75] Inventor: Robert D. Sweeney, Carrollton, Mo.

[73] Assignee: Ventek, Inc., Carrollton, Mo.

[21] Appl. No.: 09/102,993

[22] Filed: Jun. 22, 1998

[51] Int. Cl.[6] ..... B25B 1/00

[52] U.S. Cl. ..... 269/6; 269/3; 269/224; 269/240; 269/256; 269/268; 269/274; 269/275

[58] Field of Search ..... 269/221–223, 269/224, 228, 3, 6, 240, 246, 244, 250, 256, 283, 268, 274, 275, 257; 254/122, 126

[56] References Cited

U.S. PATENT DOCUMENTS

| | | | |
|---|---|---|---|
| 673,605 | 5/1901 | Jacques | 269/3 |
| 707,803 | 8/1902 | Smith | 269/256 |
| 750,756 | 1/1904 | Eklund | 269/3 |
| 823,611 | 6/1906 | Martin | 269/256 |
| 1,260,345 | 3/1918 | Dies . | |
| 1,372,833 | 3/1921 | Sauer | 269/221 |
| 1,414,354 | 5/1922 | Gibbs . | |
| 2,448,636 | 9/1948 | Surk . | |
| 2,726,694 | 12/1955 | Saxton . | |
| 3,107,716 | 10/1963 | Wehmeyer | 269/274 |
| 3,964,738 | 6/1976 | Owen | 269/221 |
| 4,181,392 | 1/1980 | Casler et al. . | |
| 4,258,908 | 3/1981 | Goff et al. . | |
| 4,276,692 | 7/1981 | Casler et al. . | |
| 4,315,424 | 2/1982 | Jarman et al. . | |
| 4,509,731 | 4/1985 | Schaal et al. | 269/283 |
| 4,784,400 | 11/1988 | Hofius | 254/122 |

*Primary Examiner*—Robert C. Watson
*Attorney, Agent, or Firm*—Shook, Hardy & Bacon L.L.P.

[57] ABSTRACT

A clamp is provided that has a pair of clamp bodies which each have an inner surface. The inner surfaces of each clamp body are oriented to face one another in a spaced parallel relationship. A pair of parallel scissors linkages are coupled to the device that operate to move the clamp bodies in parallel relation relative to one another. Each scissors linkage extends from one side surface of one clamp body to a corresponding side surface of the other clamp body. A threaded rod is coupled to the pair of scissors linkages between the clamp bodies and is oriented with its axis of rotation parallel to the inner surfaces of the clamp bodies. The threaded rod is operable to move the clamp bodies either towards one another or away from one another in spaced parallel relation by rotation of the rod. By operation of the rod, the device may be used as either a clamping device or an expansion device.

11 Claims, 2 Drawing Sheets

SOFT SQUEEZE CLAMP AND EXPANSION DEVICE

BACKGROUND OF THE INVENTION

This invention relates to a clamping device, and more particularly to an easily positionable clamping device that can be operated with one hand and which can also be used as an expansion device.

Mechanical clamping devices have existed for many, many years. These devices are useful for holding materials while work is being performed upon them, and for holding two objects together, such as when an adhesive is curing. Many improvements have been made to these clamping devices over the years, but deficiencies still exist and have not heretofore been adequately addressed.

When a prior art clamp is used, the jaws of the clamp are separated to accommodate the material to be clamped. The material is then placed intermediate the jaws of the clamp, and the clamp is operated to exert a clamping force on the material by moving the jaws closer to one another. This operation can be somewhat awkward. For example, many of the prior art clamping devices require both hands of a user to operate the clamp. This can obviously be disadvantageous because the user of the clamp will often desire to use one hand to perform work on the material being clamped. Prior art clamping devices also suffer from the disadvantage that they often tend to apply a great deal of clamping force to a particular area of the object while leaving other areas of the object subject to a lesser force. It is generally desirable to more evenly distribute the clamping force across the object being clamped. This is particularly true when the clamp is used to hold two objects together, while an adhesive is curing. Further, prior art clamps are often awkward to maneuver and do not always fit into the space where they are needed, and cannot be used in a variety of orientations.

Prior art clamps are also typically designed only to exert a clamping force on an object or objects. More specifically, the prior art clamps had heretofore not been designed to alternatively provide an expansion force between two objects without rearranging components parts of the clamp. When performing work, it may become desirable to separate two objects from each other, or to elevate one object with respect to another. Prior art clamping devices have not been useful for this purpose.

Another disadvantage of prior art clamping devices is in the configuration of the clamping jaws. In order for a clamping device to be useful in a number of applications, a number of different clamping jaw configurations should be optionally provided. These clamping jaws, in prior art clamping devices, may be serrated to provide a better clamping surface. However, the clamping jaws in prior art clamping devices do not allow for effective clamping of a large number of oddly shaped objects.

Therefore, a clamping device is needed which overcomes the drawbacks and deficiencies of the existing clamping devices discussed above.

BRIEF SUMMARY OF THE INVENTION

Accordingly, it is an object of the present invention to provide a mechanical clamping device that allows the user to operate the clamping device with one hand.

A further object of the invention is to provide true functional parallelism throughout the entire operating range of a clamping device.

Yet another object of the invention is to provide a clamping device with a unique operating mechanism, which permits changing the position of the moveable elements of the actuator relative to the fixed elements of the actuator, without affecting the parallel relationship of the clamping bodies.

Another object of the invention is to provide a mechanical clamping device that can easily be maneuvered and which has a profile allowing it to be used in cramped spaces.

A further object of the invention is to provide a mechanical clamping device that can be used both as a clamping device and as an expansion device.

A still further object of the invention is to provide a clamping device that operates to more evenly distribute the force applied across the entire clamping surface.

Yet another object of the present invention is to provide a clamp in which the clamping jaws may be optionally "customized" or configured to achieve a more effective clamping force on a particularly shaped object.

According to the present invention, the foregoing and other objects are obtained by a mechanical device that has a pair of clamp bodies which each have an inner surface. The inner surfaces of each clamp body are oriented to face one another in parallel relationship. A pair of parallel scissors linkages are coupled to opposite sides of the clamp bodies and are operable to move the clamp bodies in parallel relation relative to one another. Each scissors linkage extends from one side surface of one clamp body to a corresponding side surface of the other clamp body. A threaded rod is coupled to the pair of scissors linkages between the clamp bodies and is oriented with its axis of rotation parallel to the inner surfaces of the clamp bodies. The threaded rod is operable to move the clamp bodies either towards one another or away from one another in spaced parallel relation by rotation of the rod. By operation of the rod, the device may be used as either a clamping device or an expansion device without rearranging any components of the clamp.

Additional objects, advantages, and novel features of the invention will be set forth in part in the description which follows and in part will become apparent to those skilled in the art upon examination of the following, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWINGS

In the accompanying drawings which form a part of the specification.

DETAILED DESCRIPTION OF THE INVENTION

Figure 2:
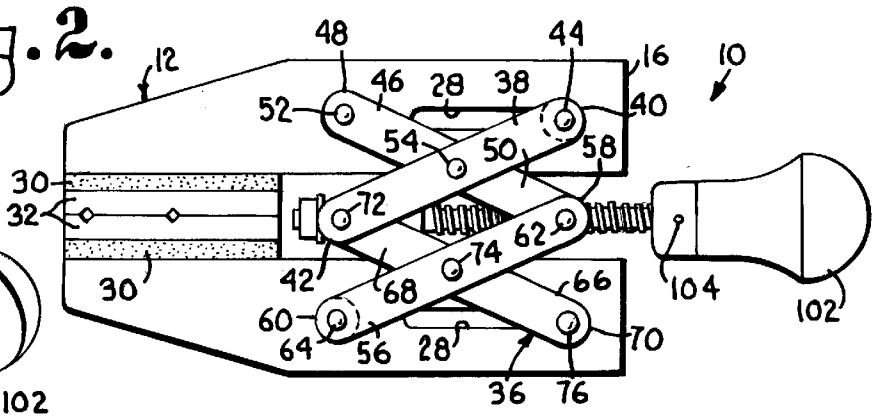
FIG. 2 is a side elevation view of the clamp of FIG. 1 in a closed position.
Figure 3:
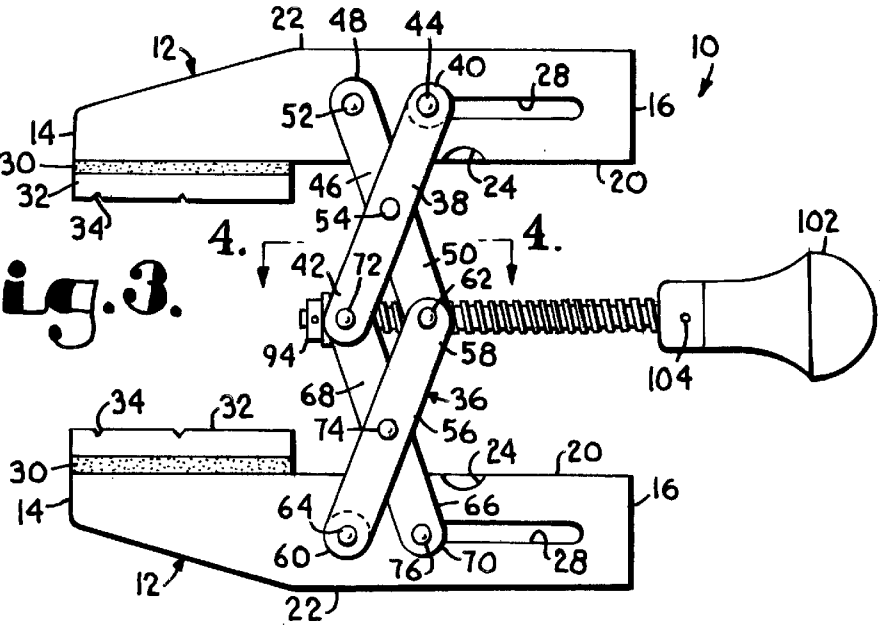
FIG. 3 is a side elevation view similar to FIG. 2, of the clamp of FIG. 1 in a generally open position.
Figure 1:
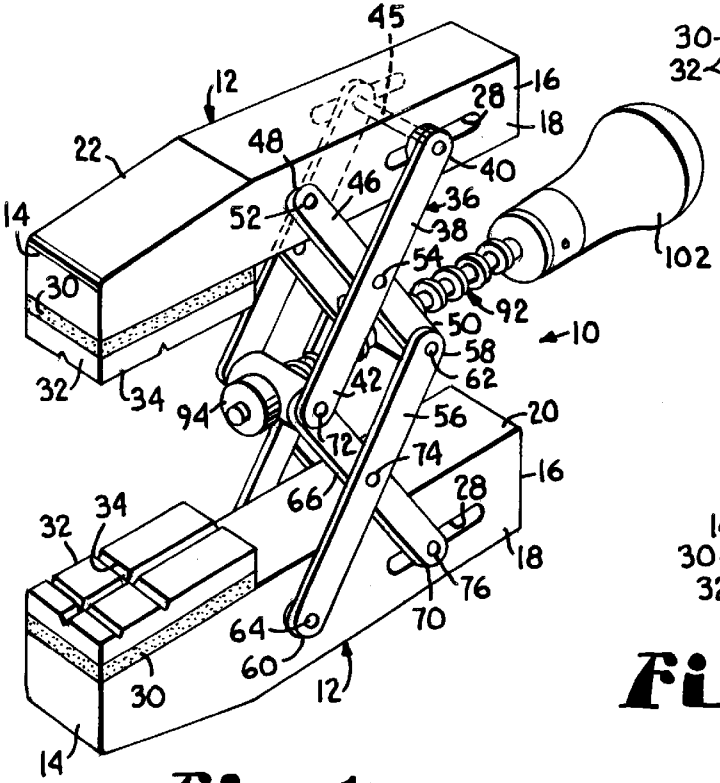
FIG. 1 is a perspective view of a clamp embodying the principles of the present invention.
Figure 8:
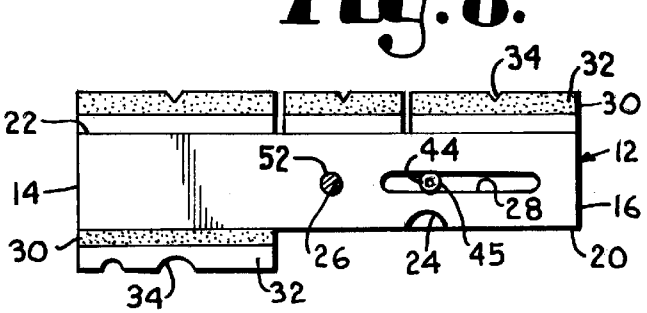
FIG. 8 is a side elevation view of one embodiment of a jaw body usable with the clamp of FIG. 1.

A clamp embodying the principals of this invention is broadly designated in the drawings by the reference numeral 10. With initial reference to FIG. 1, clamp 10 has a pair of clamp bodies 12 which face one another in a mirrored symmetry relationship. Each clamp body 12 has a first or forward end 14, a second or back end 16, opposite side surfaces 18, an inner surface 20 and an outer surface 22. Each clamp body 12 is preferably a solid body constructed of a lightweight and sturdy material, such as wood. Other materials such as plastics or metals may also be used if desired. As best seen in FIGS. 1–3, outer surface 22 may slope downwardly toward the forward end 14. Alternatively, outer surface 22 may be generally planer as best seen in FIG. 8. As seen in FIGS. 3 and 5–8, each clamp body 12 has a relief pocket 24 disposed in side surfaces 18. Relief pocket 24 is generally semi-circular in cross-section and allows clamp 10 to fully close as shown in FIG. 2 and as more fully described below.

As best seen in FIGS. 5–8, clamp body 12 is equipped with a through hole 26 which extends from one side surface 18 to the other. Disposed rearwardly of through hole 26 is an elongated slot 28 which also extends through clamp body 12 from one side surface 18 to the other. Through hole 26 and through slot 28 allow passage of connecting components used to couple clamp bodies 12 to one another in a movable, spaced relationship, as is more fully described below.

Figure 7:
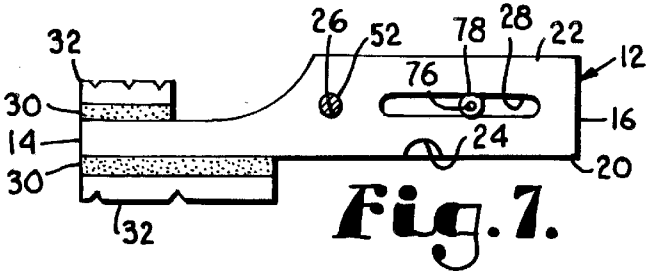
FIG. 7 is a side elevation view of one embodiment of a jaw body usable with the clamp of FIG. 1.

Attached to inner surface 20 adjacent first end 14 and extending a preselected distance towards second end 16 is a relatively thin connecting material 30. Connecting material 30 is preferably formed of a slightly resilient material and may be attached to inner surface 20 with any suitable attaching mechanism or material, such as an adhesive. Attached to connecting material 30 is a clamping panel 32, the exposed surface of which may be smooth or appropriately textured or contoured. Panel 32 is used to grip a work piece and may be equipped with a series of positioning notches 34. As shown in FIGS. 1 and 6–8, positioning notches 34 may be any of a desired configuration, depending on the work piece being clamped. Moreover, the transition from notch 34 to the surface of panel 32 may be radiused to minimize undesirable indentation markings on the work piece. Preferably, clamping panels 32 are made of wood, although other materials could be used. Surface 32 may be custom-designed or modified to be application-specific when desired. Surface 32 may therefore be designed to have a specific thermal or electrical conductivity to match the needs of the application. Connecting material 30 cooperates with clamping panel 32 to more evenly distribute the clamping pressure exerted on the work piece by clamp 10. In an alternative embodiment, shown in FIG. 5, clamp body 12 is formed with an integral clamping panel 32. In this embodiment, connecting material 30 is not used. As best seen in FIGS. 7 and 8, a connecting material 30 and a clamping panel 32 may be secured to outer surfaces 22 of the clamp bodies 12. This is especially beneficial when clamp 10 is used as an expansion device, as is more fully described below.

Clamp bodies 12 are coupled to one another in parallel relationship by a pair of double scissors linkages 36 which are coupled to clamp bodies 12 adjacent side surface 18. Each scissors linkage 36 has a first link 38 that has a first end 40 and a second end 42. First end 40 has disposed therethrough a connecting rod 44, which extends through elongated slot 28 and couples one first link 38 to the other. Disposed within slot 28, and around rod 44 is a rolling bearing sleeve 45. Sleeve 45 has an internal bore which is sized to allow free but supported movement of connecting rod 44. Slot 28 is sized to allow free but supported movement of sleeve 45. As rod 44 and sleeve 45 travel within slot 28, the clamp bodies 12 will move toward or away from each other. Connecting rod 44 is coupled to each link 38, by any suitable mechanism, such as by a friction fit, c-clips or riveting.

Scissors linkage 36 further has a second link 46 which has a first end 48 and a second end 50. Second link 46 is coupled to clamp body 12 through a fixed connecting rod 52 which extends from first end 48 of one second link 46 to the first end of the other second link. Preferably, connecting rod 52 is coupled to each link 46 such as by a friction fit. Through hole 26 is sized to provide a bearing surface for rod 52 and to support connecting rod 52, while allowing it to freely rotate therewithin. First link 38 and second link 46 are pivotally coupled together at their respective midsections with a connecting pin 54 which extends only through first link 38 and second link 46. As best seen in FIG. 1, links 38 and 46 thus form an X-shape. Pin 54 allows links 38 and 46 to rotate thereon, thus allowing clamp bodies 12 to move relative to one another, as more fully described below.

Scissors linkage 36 further has a third link 56 which has a first end 58 and second end 60. First end 58 of third link 56 is pivotally connected to second end 50 of link 46 by bolt 62. Bolt 62 maintains links 46 and 56 on a turned shoulder of a threaded sleeve assembly 80, as more fully described below. Second end 60 of third link 56 is pivotally coupled to clamp body 12 through the use of a connecting rod 64 which couples one third link 56 to another and which passes through hole 26. Connecting rod 64 is coupled to each third link 56, such as by a friction fit. Hole 26 is sized to provide a bearing surface for rod 64 and to support connecting rod 64, while allowing it to freely rotate therewithin.

Scissors linkage 36 also has a fourth link 66 which has a first end 68 and a second end 70. First end 68 of fourth link 66 is pivotally coupled to second end 42 of first link 38 by a bolt 72. Bolt 72 maintains links 38 and 66 on a turned shoulder of a front bearing block 82, as is more fully described below. Third link 56 is pivotally coupled to fourth link 66 at the midsection of each link through a connecting pin 74 which extends only through third link 56 and fourth link 66. Finally, second end 70 of fourth link 66 is coupled to clamp body 12 and to the opposite fourth link 66 through a traveling connecting rod 76, which passes through elongated slot 28. Disposed within slot 28, and around rod 76, is a rolling bearing sleeve 78. Sleeve 78 has an internal bore which is sized to allow free but supported movement of rod 76. Slot 28 is sized to allow free but supported movement of sleeve 78. As sleeve 78 and rod 76 travel within slot 28, clamp bodies 12 will move toward or away from one another.

Each scissors linkage 36 is thus coupled to each clamp body 12 adjacent side surfaces 18. First link 38 and second link 46 are pivotally coupled to one another in an X-shape, and to one clamp body 12. Third link 56 and fourth link 66 are pivotally coupled to one another in an X-shape, and to the other clamp body 12. Finally, first link 38 is pivotally coupled to fourth link 66 and second link 46 is pivotally coupled to third link 56. As more fully described below, scissors linkages 36 couple clamp bodies 12 to one another, allowing them to move in a spaced, parallel orientation relative to one another.

Figure 4:
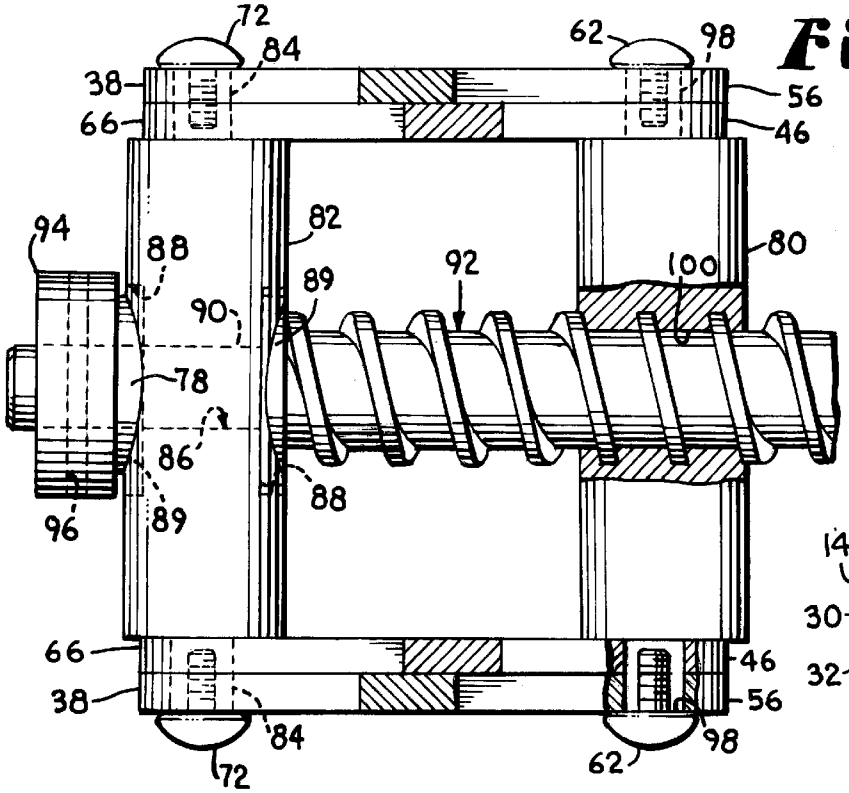
FIG. 4 is a partial cross-sectional view, taken along line 4—4 of FIG. 3, with parts being broken away to show particular details of construction.
Figure 5:
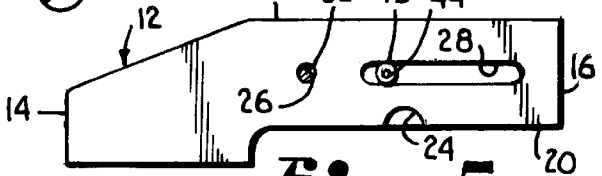
FIG. 5 is a side elevation view of one embodiment of a jaw body usable with the clamp of FIG. 1.
Figure 6:
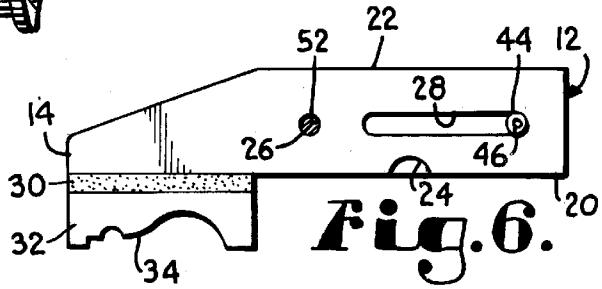
FIG. 6 is a side elevation view of one embodiment of a jaw body usable with the clamp of FIG. 1.

As best seen in FIGS. 1 and 4, a front bearing block 82 and a threaded sleeve assembly 80 are coupled to and between scissors linkages 36. Front bearing block 82 is a single piece. As best seen in FIG. 4. Each end of block 82 is turned down to create an integral shoulder 84. Upon shoulders 84 is placed second end 42 of first link 38 and the first end 68 of fourth link 66. Each shoulder 84 has an internal threaded bore and links 38 and 66 are maintained on shoulder 84 by placing bolts 72 within the bores of shoulder 84. Links 38 and 66 are thus allowed to pivot on shoulder 84. The corresponding scissors linkage 36 on the opposite side of clamp body 12 is similarly connected to block 82.

As best seen in FIG. 4, block 82 has an internal bore 86. Internal bore 86 accommodates a front, non-threaded, shouldered end 90 of a threaded rod 92. Front bearing block 82 has a pair of radially milled counter-sink surfaces 88 as best seen in FIG. 4. Counter-sinks 88 are centered on the same axis as rod 92 and accommodate a pair of bearings 89. Bearings 89 are preferably held within countersink 88 in a press-fit relationship. End 90 of rod 92 extends through bore 86 and bearings 89. Rod 92 is prevented from axial movement within block 82 via a retaining cap 94. Retaining cap 94 may be held on end 90 by suitable attaching means, such as with a roll pin. End 90 is thus equipped with a matching bore hole to accommodate the roll pin or other attaching mechanism. For this purpose, cap 94 is equipped with a bore 96. Through this attachment method, threaded rod 92 is allowed to rotate within front bearing block 82 but is prevented from moving axially within front bearing block 82.

Threaded sleeve assembly 80 is coupled to and between scissors linkages 36, and specifically to and between the intersection of second link 46 and third link 56. Sleeve assembly 80 is preferably a single piece, and has an integral shoulder 98. Each shoulder 98 has a threaded bore to accommodate bolts 62 and links 46 and 56 are maintained on shoulder 98 by placing bolts 62 within the bores of shoulder 98. Shoulders 98 allow second link 46 and third link 56 to pivotally rotate thereabout and are constrained and captivated by end bolts 62. However, end bolts 62 are secured to sleeve assembly 80 such that sleeve assembly 80 does not rotate with threaded rod 92. Sleeve assembly 80 has an internal, threaded bore 100 that is internally threaded to mate with the threads on threaded rod 92. Threaded rod 92 is therefore held within sleeve assembly 80 and bearing block 82 constrained but with appropriate clearances to rotate freely within. As best seen in FIGS. 1–3 located rearwardly of second end 16 along threaded rod 92 is a handle 102. Handle 102 is attached to threaded rod 92 with a roll pin 104. Handle 102 is somewhat bell-shaped to enhance comfort and provide for greater torque ability in use.

Rotation of handle 102 causes threaded rod 92 to rotate within and through sleeve assembly 80. While threaded rod 92 is rotating within sleeve assembly 80, end 90 of rod 92 will rotate within front bearing block 82. As threaded rod 92 rotates within sleeve assembly 80 in one direction, the distance between sleeve assembly 80 and front bearing block 82 is increased. In other words, rotation of handle 102 in one direction causes sleeve assembly 80 to be moved away from front bearing block 82. As sleeve assembly 80 moves away from front bearing block 82, the distance between the integral end shoulders 84 of front bearing block 82 and the integral end shoulders 98 of sleeve 80 increases. As the distance between these integral end shoulders increases, rod 44, sleeve 45, rod 76 and sleeve 78 move toward second end 16 within slot 28. This movement allows clamp bodies 12 to move toward one another in a closing fashion. Eventually, clamp bodies 12 will be in a closed relationship with clamping panels 32 in abutting relationship, as shown in FIG. 2. Relief pocket 24 accommodates connecting pins 54 and 74 so that they do not prevent clamp bodies 12 from being completely closed.

Scissors linkages 36 ensure that clamp bodies 12 move parallel to one another as they are moved closer to or farther apart from one another. As best seen in FIG. 1, clamp bodies 12 may be held in spaced relationship, parallel regardless of relative spacing, by rotating handle 102. When handle 102 is released, sleeve assembly 80 operates to hold clamp bodies 12 in spaced position. Therefore, clamp 10 may be used as a clamp by rotating handle 102 in one direction, thus moving clamp bodies 12 and clamping panels 32 towards one another and effecting a clamping force on the work piece. Connecting material 30 operates to more evenly distribute the clamping forces applied to the work piece. Positioning notches 34 may be used to better grip a particular work piece. Clamp bodies 12 and clamping panels 32 may be any of a number of different configurations, some of which are shown in FIGS. 5–8. Clamp 10 may therefore be constructed to accommodate a variety of differently shaped objects.

Conversely, clamp 10 may be used as an expansion device, or separator. For this purpose, handle 102 is rotated until clamp bodies 12 are sufficiently close together to allow clamp 10 to be placed between the two objects desired to be separated. Thereafter, handle 102 may be rotated in an opposite direction to impart a separating force on clamp bodies 12 and the two objects desired to be separated. Therefore, clamp 10 can be used as either a clamp or as a separating device through the use of handle 102 and threaded rod 92 without rearranging any clamp parts. When threaded rod 92 is located between clamp bodies 12 and perpendicular to the direction of travel of clamp bodies 12, thus allowing clamp 10 to be used as an expansion device and doing so in a manner that efficiently uses the available space.

In addition to threaded rod actuator 92 previously described other types of actuators may be appropriately used in place of rod 92. If a greater clamping force or a faster closure speed is needed than can be achieved with rod 92, a different actuator may be used. Similarly, a different actuator may be used in situations involving high frequency use or where a precise closure dimension or force is needed. Actuators usable in these situations include hydraulic or pneumatic cylinders or diaphragms, electromechanical actuating devices or electromagnetic devices.

From the foregoing, it will be seen that this invention is one well adapted to obtain all of the ends and objects hereinabove set forth, together with other advantages which are inherent to the structure. It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A mechanical device, comprising:

a first-clamp body having a first end, a second end, a first inner surface extending between said first end and said second end;

a second clamp body having a first end, a second end, a second inner surface extending between said first end and said second end; said second clamp body oriented with respect to said first clamp body such that said second inner surface faces said first inner surface;

a pair of scissors linkages coupling said first body and said second body in spaced, parallel relationship;

a threaded rod having an axis of rotation that is oriented parallel to said first inner surface and said second inner surface, said rod being coupled between said pair of scissors linkages and between said first clamp body and said second clamp body, said threaded rod being operable to expand and contract said scissors linkages to move said first clamp body and said second clamp body relative to one another in spaced parallel orientation; and a bearing assembly and a threaded sleeve assembly coupled between said first scissors linkage and said second scissors linkage, said threaded rod being rotatingly disposed in said bearing assembly and threadedly disposed through said sleeve assembly, wherein said mechanical device can be used as a clamping device or an expansion device upon operation of said threaded rod.

2. The mechanical device of claim 1, wherein said threaded rod has a first end located generally between said first clamp body and said second clamp body, and a second end distal from said first end, said second end having a handle coupled therewith, said handle operable to rotate said threaded rod.

3. The mechanical device of claim 2, further comprising a first clamping panel coupled to said first inner surface adjacent said first end of said first clamping body and a second clamping panel coupled to said second inner surface adjacent said first end of said second clamping body.

4. The mechanical device of claim 3, wherein said first and second clamping panels have a positioning notch formed therein to assist in gripping an object between said first and second clamp bodies.

5. The mechanical device of claim 4, further comprising a resilient material coupled between said first clamping panel and said first inner surface and between said second clamping panel and said second inner surface, wherein said material distributes a force applied to said first and second clamping panels.

6. The mechanical device of claim 5, wherein said first clamp body has a first outer surface opposite said first inner surface and said second clamp body has a second outer surface opposite said second inner surface, said device further comprising an expansion panel coupled to each of said first and second outer surfaces.

7. The mechanical device of claim 6, further comprising a resilient layer coupled between said first outer surface and said expansion panel and between said second outer surface and said expansion panel.

8. A mechanical device, comprising:

a first clamp body having a first end, a second end, a pair of opposing side surfaces extending between said first and second ends and a first inner surface;

a second clamp body having a first end, a second end, a pair of opposing side surfaces extending between said first and second ends and second inner surface, said second clamp body oriented with respect to said first clamp body such that said second inner surface faces said first inner surface;

a linkage coupling said first body and said second body in spaced, parallel relationship, said linkage including a first scissors linkage coupled to one of said side surfaces on said first clamp body and a corresponding side surface of said second clamp body, said linkage further including a second scissors linkage coupled to the other of said side surfaces on said first clamp body and a corresponding side surface of said second clamp body, said first and second scissors linkages oriented in spaced, parallel orientation with respect to one another;

an actuating device comprising a threaded rod having an axis of rotation parallel to said first inner surface and said second inner surface, said actuating device being located between said first and second clamp bodies and being coupled to said linkage and being operable to move said first clamp body and said second clamp body relative to one another in spaced parallel orientation; and a bearing assembly and a threaded sleeve assembly coupled between said first scissors linkage and said second scissors linkage, said threaded rod being rotatingly disposed in said bearing assembly and threadedly disposed through said sleeve assembly, wherein said mechanical device can be used as a clamping device or an expansion device upon operation of said actuating device.

9. The mechanical device of claim 8, further comprising a first clamping panel coupled to said first inner surface and a second clamping panel coupled to said second inner surface, said clamping panels having positioning notches formed therein.

10. The mechanical device of claim 9, further comprising a resilient material coupled between said first inner surface and said first clamping panel and between said second inner surface and said second clamping panel, wherein said material generally evenly distributes a force exerted upon an object placed between said clamping panels upon operation of said threaded rod.

11. The mechanical device of claim 10, wherein said threaded rod has a first end and a second end distal from said first end, said first end of said rod being coupled to said linkage, said mechanical device further comprising a handle coupled to said second end of said rod, wherein said handle is operable to effect rotation of said rod.

* * * * *